United States Patent [19]

Zverev et al.

[11] 4,004,735

[45] Jan. 25, 1977

[54] APPARATUS FOR DETONATING APPLICATION OF COATINGS

[76] Inventors: Anatoly Ivanovich Zverev, ulitsa Bratislavskaya, 26, kv. 22, Kiev; Alexandr Sergeevich Bondarenko, ulitsa Nizhegorodskaya, 26, kv. 40, Moscow; Mikhail Antonovich Pudzinsky, ulitsa Sverdlova, 13, kv. 21, Kiev; Vadim Mikhailovich Sopryazhinsky, ulitsa Bogdanovskaya, 5a, kv. 32, Kiev; Nikolai Alexeevich Yakshin, ulitsa Kartvilishvili, 3v, kv. 51, Kiev, all of U.S.S.R.

[22] Filed: June 3, 1975

[21] Appl. No.: 583,246

[30] Foreign Application Priority Data

June 12, 1974 U.S.S.R. ..... 2028702
June 12, 1974 U.S.S.R. ..... 2028703

[52] U.S. Cl. ..... 239/79
[51] Int. Cl.² ..... B05B 1/24
[58] Field of Search ..... 239/79, 81, 85

[56] References Cited

UNITED STATES PATENTS

| | | | |
|---|---|---|---|
| 2,754,225 | 7/1956 | Gfeller | 239/81 X |
| 2,950,867 | 8/1960 | Hawley et al. | 239/85 X |
| 3,773,259 | 11/1973 | Zverev | 239/81 |
| 3,801,346 | 4/1974 | Melton, Jr. | 239/81 X |

*Primary Examiner*—John J. Love

[57] ABSTRACT

The apparatus comprises an explosion chamber 1 in the form of a tube closed at one end and communicating through a discharge pipe with a powdered coating batcher while a safety pipe communicates it with a mixing chamber 9 which prepares the explosive mixture ignited in the explosion chamber 1 by a spark plug 21. Installed between the safety pipe and the explosion chamber 1 is a circular precombustion chamber 10 which surrounds said explosion chamber and communicates with its space through holes 11 in its walls 12. The end of the discharge pipe 5 mounts a jet nozzle 13 which is installed in the face of the closed end of the explosion chamber coaxially with the latter so that its outlet section 16 is arranged ahead of the holes 11 in the walls of the explosion chamber 11 relative to the open end 17 of the latter. Due to such an arrangement, the process of discharge of the explosive mixture from the precombustion chamber 10 through the holes 11 in the walls 12 of the explosion chamber 1 into the space around the nozzle 13 is accompanied by drawing in the powdered coating from the nozzle 13 and its intensive mixing with the explosive mixture which produces a homogeneous two-phase mixture and a more uniform coating and ensures a more economical operation of the apparatus due to a more rational utilization of the coating materials.

3 Claims, 3 Drawing Figures

APPARATUS FOR DETONATING APPLICATION OF COATINGS

The present invention relates to apparatuses for application of coatings to the surfaces of parts by spraying the material of the coating and more specifically it relates to the apparatuses for detonating application of coatings utilizing the effect of detonation in gases for treatment of materials.

It is known that if a long tube closed at one end is filled with an explosive mixture capable of exothermic reaction and said mixture is ignited at the closed end by means of, say, an electric spark, the flame front will propagate at an ever-increasing speed until a detonation wave is originated at a certain distance from the point of ignition. Such a wave has constant high pressure and temperature and is propagated at a constant speed which reaches a maximum for the given explosive material and the given conditions, said speed approaching 2–4 km/s.

The effect of detonation has found a wide field of usefulness for pressing large articles, removing scale after heat treatment, spheroidizing the particles of the powders made of various materials including high-melting and low-temperature ones, and in the apparatuses for detonating application of coatings.

The present invention can be employed most successfully for applying all kinds of coatings practically to any metals, alloys and nonmetallic materials. The coatings can be made of metals, hard cerametallic alloys, high-melting compounds, cermets and a number of modern complex materials.

Known in the previous art are apparatuses for detonating application of coatings (see, for example, U.S. Pat. No. 3,773,259, Class 239/81, USA), comprising an explosion chamber in the form of a cylindrical calibrated tube of a certain length and diameter closed at one end, said length and diameter being sufficient for originating and propagating a detonation wave, and communicating through a safety pipe with a mixing chamber where the explosive mixture is prepared a powdered coating batcher, and at least one spark plug for igniting the explosive mixture.

The mixing chamber has valves for the delivery of the components of the explosive mixture, i.e. combustible gas (acetylene) and oxidizer (oxygen) and a valve for the delivery of the neutral carrying gas (nitrogen). All these valves are operated by an electronic control unit.

On commands given by the control unit the valves open in a certain sequence, ensuring the supply of the explosive components into the mixing chamber where said components are mixed. The explosive mixture thus formed enters the explosion chamber which is simultaneously supplied with the powdered coating from the batcher.

On deliverying a certain portion of the mixture the valves close and the mixing chamber is supplied with carrying gas after which the explosive mixture is ignited by a spark plug, explodes and liberates gases in the explosion chamber at a high pressure and temperature.

The products of explosion which are strongly compressed at the moment of detonation are those physical agents whose transformation causes an instantaneous transition of the potential energy of the mixture into the kinetic energy of the moving gases. This energy is conveyed to the particles of the powdered coating suspended in the stream of gases; these particles are heated, accelerated and, being discharged from the tube of the explosion chamber, form a coating on the surface of a part.

Experience gained in operating the known apparatus has proved that homogeneous and high-quality coatings will not be obtained unless all possible measures are taken to ensure complete mixing of the explosive mixture with the powdered coating in order to distribute uniformly the pulverized particles in the explosive mixture and thus to produce a two-phase system wherein the density of the particles varies but little throughout the length of the tube.

It is commonly presumed that a cylindrical pipe connection installed in the face of the explosion chamber is sufficient for blowing the powdered coating into it. However, it has been experimentally established that in this method of powder admission, the powder occupies an elliptical volume stretched over the length of the explosion chamber, the concentration of the particles being greatest in the middle gradually diminishing towards the ends. The gas carrying the powdered coating from the batcher thins out considerably the explosive mixture so that its concentration throughout the tube also varies. All these factors have a considerable bearing on the homogeneity and quality of the produced coatings.

There have been attempts to counter this disadvantage by changing the length and diameter of the pipe connection and by diminishing the amount of gas blown in together with the powder, simultaneously increasing the pressure pulse. However, this involves a considerable increase in the hydraulic losses for friction while a longer pipe connection distorts the inside configuration of the tube, occupying its main central part, so that most of these attempts proved ineffective.

Besides, it has been found during operation of the known apparatuses that better reliability and operational efficiency of all the elements and units of the apparatuses call for stationary cyclic ignition of the explosive mixture which is one of the paramount factors affecting the homogeneity and quality of the coatings.

Such a stable ignition is ensured by a spark plug installed directly in the explosion chamber (like it is done in I.C. engines) and guarantees failsafe functioning of the apparatus.

It has been established experimentally that the detonation wave created during explosion of the mixture is not homogeneous, consisting of a combustion zone, an impact wave zone and a back wave zone. Owing to a specific nature of the process the back waves propagate in the direction contrary to that of the main stream of gases. Here it shall also be noted that the explosion of the mixture is followed by a vacuum in the chamber which causes the powder to be partly drawn towards the closed end of the explosion chamber.

The back waves and the natural vacuum cause the particles of the powdered coating to penetrate into the electrode gap of the spark plug and thus ruin the plug prematurely.

An attempt to eliminate this disadvantage by using high-voltage electrodes instead of the spark plug has not provided a desirable solution since this has led to a considerable increase in the size of the explosion chamber and, what is most important, in the power of the high-voltage source.

Apart from the use of high-voltage electrodes, there was an attempt to ignite the explosive mixture with high-speed impact waves. However, such a system calls for the use of a powerful impact-wave generator and is, therefore, not economical.

An object of the present invention is to provide an apparatus for detonating application of coatings with such an explosion chamber which would ensure better mixing of the explosive mixture with the powdered coating for producing homogeneous and high quality coatings.

This and other objects are accomplished by providing an apparatus for detonating application of coatings comprising an explosion chamber in the form of a tube closed at one end and communicating through an outlet pipe connection with a powdered coating batcher while a safety pipe connects it with a mixing chamber preparing the explosive mixture, the apparatus being provided with at least one spark plug for igniting said mixture. According to the invention, there is a circular precombustion chamber installed between the safety pipe and the explosive chamber and surrounding the latter, the inside space of said precombustion chamber communicating with the explosion chamber through holes in its walls, and the end of the outlet pipe connection is provided with a jet nozzle installed in the face surface of the closed end of the explosion chamber, coaxially with the latter, so that the outlet of said nozzle is located ahead of the holes in the explosion chamber walls with relation to the open end of said chamber.

Such an arrangement makes it possible to dissect preliminarily the stream of the explosive mixture flowing from the circular precombustion chamber thereby eliminating the pressure fluctuations and ensuring uniform admission of the mixture flow into the explosion chamber.

Besides, such an arrangement of the jet nozzle in the face wall of the explosion chamber when the outlet of the nozzle is located ahead of the holes in the chamber walls relative to the outlet from the explosion chamber ensures sucking of the powdered material from the nozzle and its intensive mixing with the explosive mixture in the course of discharge of the explosive mixture from said holes.

It is practicable that the holes should be uniformly arranged around the cross section perimeter of the explosion chamber and that the axes of these holes should be inclined towards the open end of said chamber at one and the same angle to its axis.

Such a solution guarantees a more efficient utilization of the energy of the stream of the explosive mixture because the velocity of this flow near the walls of the explosion chamber is considerably higher than it is along its axis which intensifies the mixing of the powder with the explosive mixture.

It is likewise practicable that the inside surface of the explosion chamber walls at the location of the precombustion chamber should be shaped as a truncated cone narrowing towards the open end of the explosion chamber, said cone merging through a cylindrical portion and a surface with a back cone into the surface of the explosion chamber tube.

As a result, the stream of the explosive mixture would be compressed still stronger and, without extra expenditures of energy, its speed would be increased at the entrance into the cylindrical portion where the mixture is finally mixed with the powdered coating.

The spark plugs can be installed in the outer wall of the precombustion chamber, at points located opposite the spaces between the holes in the explosion chamber walls.

In such an arrangement it becomes possible to produce a preliminary flame ignition in a relatively small explosion chamber and, in particular, to protect the spark plug electrodes against contact with the powdered coating, thus providing for high reliability of the apparatus as a whole and producing homogeneous high-quality coatings.

Now the invention will be described in detail by way of example with reference to the accompanying drawings, in which.

Figure 1:
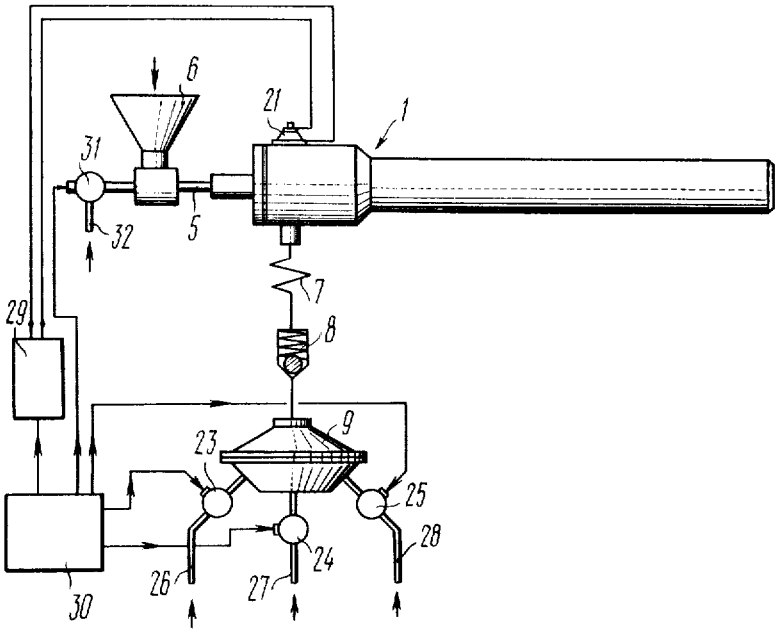
FIG. 1 is a schematic general view of the apparatus for detonating application of coatings according to the invention.

The apparatus according to the invention comprises an explosion chamber 1 (FIGS. 1 and 2) in the form of a tube closed at one end, which can take either vertical or horizontal position and is enclosed in a cylindrical water-cooling jacket 2.

The jacket 2 is provided with pipe connections 3, 4 for letting the water in and out.

At the closed end the explosion chamber 1 communicates through a discharge pipe connection 5 with a powdered coating batcher 6 while a safety pipe 7 in the form of a coil and a non-return valve 8 put it in communication with a mixing chamber 9.

Installed between the safety pipe 7 and the explosion chamber 1, according to the invention, is a circular precombustion chamber 10 surrounding said explosion chamber; the space 10' of the precombustion chamber 10 communicates with the space 1' of the explosion chamber 1 through holes 11 in the walls 12 of the latter.

The end of the discharge pipe connection 5 is mounted, according to the invention, with a jet nozzle 13 which can be removed to give free access to the holes 11 in the walls 12 of the chamber 1 for inspection. The nozzle 13 is held by screws 14 to the face of the explosion chamber 1. This joint is made tight by a sealing ring 15 accommodated in a circular recess of the chamber 1.

The jet nozzle 13 is installed in the face of the explosion chamber 1, coaxially with the latter, and the outlet hole 16 of said nozzle 13 is arranged, according to the invention, ahead of the holes 11 in the walls 12 of the explosion chamber 1 relative to the open end 17 of the latter. As a result, the discharge of the explosive mixture from the holes 11 is accompanied by the drawing of the powdered coating from the nozzle 13 into the space 1' of the chamber 1 and its intensive mixing with the explosive mixture.

At the point where the walls 12 of the explosion chamber 1 are surrounded by the circular precombustion chamber 10 said walls have the shape of a truncated cone 18 narrowing towards the open end 17 of the explosion chamber 1 and merging via a cylindrical portion 36 of the explosion chamber into a back (flaring out) cone 19 which further merges into the tube 20 of the explosion chamber 1.

Figure 3:
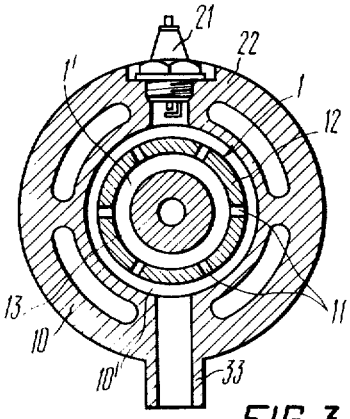
FIG. 3 is a section taken along line III—III in FIG. 2.

The holes 11 (FIG. 3) in the walls 12 of the explosion chamber 1 are arranged, according to the invention, uniformly around the perimeter of its cross section, the axes of said holes 11 being inclined at one and the same angle towards the axis of the chamber 1, in the direction of its open end 17.

The spark plug 21 is installed in the external wall 22 (FIG. 3) of the precombustion chamber 10 opposite the space between the holes 11 in the walls 12 of the explosion chamber 1.

The mixing chamber 9 is communicated with the sources (not shown in the drawing) of one of the components of the explosive mixture by means of electromagnetic valves 23, 24 and 25 and respective inlet pipes 26, 27 and 28.

In the given apparatus the valve 23 communicates with the source of oxidizer (oxygen), valve 24 communicates with the source of neutral gas (nitrogen) while the fuel (acetylene is supplied through the valve 25.

In addition to the above-mentioned operating elements the apparatus comprises a high-voltage pulse generator 29 and a control unit 30.

The apparatus for detonating application of coatings operates as follows.

Figure 2:
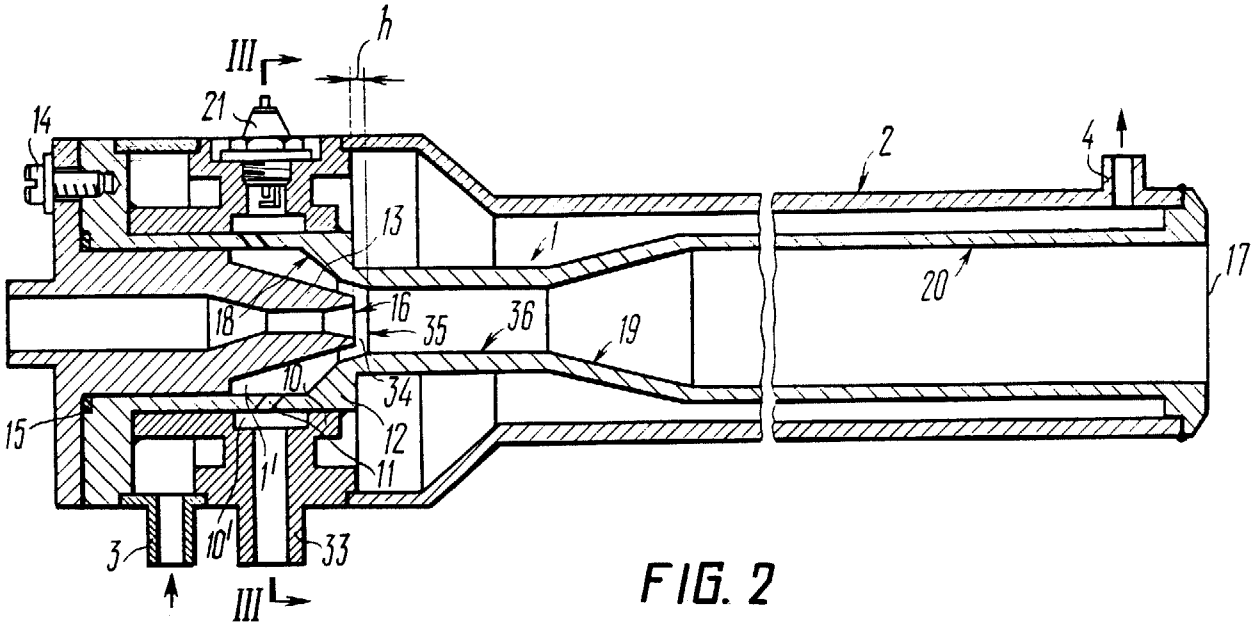
FIG. 2 is a side view, enlarged, of the explosion chamber, axial section.

In accordance with the predetermined control cyclogram the control unit 30 sends coded pulses (their direction is shown in FIG. 1 by arrows) to the electromagnetic valves 23, 24, 25 and 31. In addition, the control unit 30 sends a signal to the high-voltage pulse generator 29 which relays a signal to the spark plug 21 to ignite the explosive mixture in the explosion chamber.

At the initial movement, on the command of the control unit 30, the electromagnetic valves 23, 24, 25 and 31 open and deliver the oxidizer, neutral gas and fuel. The neutral gas delivery valve 24 can be set either to OPEN or CLOSED position depending on the required percentage of the components in the explosive mixture.

Adding various portions of the neutral gas to the mixture with the aid of the valve 24 it becomes possible to adjust within wide limits the temperature, pressure and velocity of the detonation wave and thus to select promptly the required operating conditions of the apparatus for various coating materials.

The valve 31 connected by pipe 32 with the source (not shown) of the working medium admits the carrying gas (nitrogen, air) which is used to blow the powdered coating into the tube 20 of the explosion chamber 1.

On opening of the electromagnetic valves 2, 24, 25, the oxidizer, neutral gas and fuel enter the mixing chamber 9 where they are mixed up and form a homogeneous explosive mixture which passes the nonreturn valve 8, safety pipe 7 and inlet channel 33 and fills the explosion chamber 1.

The amount of the delivered powdered coating is set by the batcher 6 which adjusts the required flow rate of the carrying gas through the valve 31. In the given apparatus the geometric parameters of the jet nozzle 13 and mixing space 34 of the explosion chamber 1 as well as the parameters of the gas carrying the powdered coating, powder proper and explosive mixture (which serves as an active gas relative to the carrying gas) are selected so that admission of the powder and explosive mixture into the mixing space 34 is accompanied by a vacuum in the zone of the outlet hole 35, said vacuum ensuring an optimum drawing in of the powder and its subsequent complete mixing in the cylindrical portion 36 of the chamber 1. In such an arrangement the flow of explosive mixture and powder at the inlet into the cylindrical portion 36 is heavily turbulent and has a high velocity near the walls 12 of the chamber 1 which ensures a practically complete mixing of the powder with the explosive mixture and, as a result, produces homogeneous high-quality coatings.

Passing through the space 19 with the flaring-out truncated cone 12 (said space serving to equalize the pressure and the field of velocities of the flow over the entire cross section of the explosion chamber 1), the two-phase mixture enters the tube 20 of the explosive chamber 1. The profile of velocities of the summary two-phase flow through the length of the tube 20 becomes equalized and stays constant. This factor is most important for producing homogeneous high-quality coatings with good operational properties.

As the explosion chamber 1 gets filled with the two-phase explosive mixture, all the valves 23, 24, 25 and 31 close and the control unit 30 gives a signal for opening the neutral gas valve 24 and to the high-voltage pulse generator 29 which, in its turn, sends a signal to the spark plug to ignite the mixture.

As soon as the neutral gas forces out the remaining explosive mixture from the mixing chamber 9 the mixture is ignited while on completion of the process the explosion chamber 1 is scavenged with neutral gas by means of the same valve 24. Then the whole operating cycle of the apparatus is repeated over again.

The use of the apparatus according to the invention ensures high reliability and safety of operation of all the units and mechanisms and improves the efficiency of utilization of the powdered coating.

The provision of the circular precombustion chamber 10 which communicates with the explosion chamber 1 through the holes 11 in the walls 12 of the latter and the arrangement of the spark plug 21 in the space 10′ of the precombustion chamber 10 give the following possibilities: on the one hand it becomes possible to dissect preliminarily the flow of the explosive mixture, eliminate the pressure fluctuations caused by the instability of operation and ensure a uniform flow of the mixture into the explosion chamber 1; on the other hand it provides for a preliminary flame ignition and protects the spark plug electrodes against contact with the powdered coating, thereby promoting high reliability of operation.

The holes 11 for the admission of explosive mixture into the explosion chamber 1 are made in the walls 12 of the latter and are uniformly located around the perimeter of its cross section while the axes of these holes are inclined towards the outlet hole 17 of said chamber at one and the same angle. This ensures a more effective utilization of the energy of the explosive mixture flow so that its velocity near the walls 12 of the chamber 1 becomes considerably higher than along the axis which has exerted a positive influence on the processes of mixing and formation of homogeneously high-quality coatings because the profile of the flow velocities at the outlet from the portion 18 of the explosion chamber 1 has become almost uniform throughout the section of its tube 20.

While applying coatings consisting of various materials, it is necessary to change the technological parameters of the process and, as a consequence, the operating conditions of the apparatus to suit the nature of each of said materials.

The apparatus described above surpasses the existing apparatuses in simplicity and ease with which these operating conditions can be changed, in fact it amounts to rotating the knobs of the corresponding switches on the control desk so that supervision of the operating process in accordance with a preset cyclogram does not call for high qualifications of the operators.

The detonation coatings applied to various articles in accordance with the above-described method are widely and successfully employed in various branches of machine and instrument building. The detonation coatings increase dozens of times the wear and corrosion resistance of parts and units working under tough and strenuous conditions so that their introduction into various fields of a country's economy gives a considerable saving.

What we claim is:

1. Apparatus for the application of coatings by detonation comprising; an explosion chamber in the form of a tube closed at one end; a batcher for powdered coating with a discharge pipe; a jet nozzle secured to the end of said discharge pipe and communicating the latter with the space of said explosion chamber; a circular precombustion chamber surrounding said explosion chamber near its closed end and communicating with its space through holes in the walls of said explosion chamber; a mixing chamber which prepares the explosive mixture; a safety pipe provided for communicating said mixing chamber with said precombustion chamber for delivering the explosive mixture from said mixing chamber through said precombustion chamber and said holes in the walls of said explosion chamber into its space; said jet nozzle installed in the face of the closed end of said explosion chamber so that its outlet section is located ahead of said holes in the walls of said explosion chamber relative to its open end, and the discharge of the powdered material from said nozzle into the space of said explosion chamber is accompanied by drawing the powdered material from said nozzle into the space of said explosion chamber by the vacuum created by the explosion and its intensive mixing with the explosive mixture; at least one spark plug for igniting the explosive mixture installed on the external wall of the precombustion chamber at a point located opposite the spaces between the holes in the walls of the explosion chamber so that a detonating wave originated in said explosion chamber throws the powdered coating through the open end of said explosion chamber onto the surface of the article located in front of it.

2. Apparatus as in claim 1, wherein the holes are arranged uniformly around the perimeter of the cross section of the explosion chamber and the axes of said holes are inclined towards the open end of said chamber at one and the same angle to its axis.

3. Apparatus as in claim 1, wherein the internal surface of the walls of the explosion chamber at the point of installation of the precombustion chamber has the form of a truncated cone narrowing towards the open end of the explosion chamber, said cone merging into the tube of the explosion chamber via a cylindrical portion and a surface with a back cone.

* * * * *